US005916316A

United States Patent [19]

Fischer

[11] Patent Number: 5,916,316

[45] Date of Patent: Jun. 29, 1999

[54] DEEP DRAW SUPERPLASTICALLY FORMED PART USING PRETHINNING

[75] Inventor: John Robert Fischer, Seattle, Wash.

[73] Assignee: The Boeing Company, Seattle, Wash.

[21] Appl. No.: 08/970,819

[22] Filed: Nov. 14, 1997

Related U.S. Application Data

[60] Continuation of application No. 08/466,507, Jun. 6, 1995, which is a division of application No. 08/224,212, Apr. 7, 1994, Pat. No. 5,823,032.

[51] Int. Cl.[6] ..... B21D 22/10; B21D 26/02

[52] U.S. Cl. ..... 72/60; 72/709; 29/421.1

[58] Field of Search ..... 72/57, 60, 63, 72/709; 29/421.1

[56] References Cited

U.S. PATENT DOCUMENTS

| | | | |
|---|---|---|---|
| 3,530,699 | 9/1970 | Uberbacher . | |
| 3,934,441 | 1/1976 | Hamilton et al. . | |
| 4,045,986 | 9/1977 | Laylock et al. . | |
| 4,266,416 | 5/1981 | Festag et al. . | |
| 4,409,809 | 10/1983 | Buchanan . | |
| 4,460,657 | 7/1984 | Elrod et al. . | |
| 4,644,626 | 2/1987 | Barnes et al. . | |
| 4,713,953 | 12/1987 | Yavari . | |
| 4,821,546 | 4/1989 | Story . | |
| 4,840,053 | 6/1989 | Nakamura | 72/58 |
| 4,928,509 | 5/1990 | Nakamura | 72/61 |
| 5,215,600 | 6/1993 | Bertolini et al. | 72/709 |
| 5,466,506 | 11/1995 | Freitas et al. . | |

FOREIGN PATENT DOCUMENTS

| | | | |
|---|---|---|---|
| 0 502 620 | 9/1992 | European Pat. Off. . | |
| 2647373 | 11/1990 | France . | |
| 4134596 | 4/1993 | Germany | 72/60 |
| 197020 | 8/1989 | Japan | 72/60 |
| 35026 | 11/1995 | Japan . | |

*Primary Examiner*—David Jones
*Attorney, Agent, or Firm*—John C. Hammar

[57] ABSTRACT

A superplastically formed part having tailored thickness in particular areas Includes a formed blank having a preformed portion and a formed portion. The preformed portion is preformed as a bulge into a recess in a die lid, and then the bulge is reversed into a cavity in a die base as a prethinned area which delivers unthinned portions of the blank for final forming to regions of the die base cavity over which thinned portions of the blank would otherwise be formed and further thinned by final forming.

5 Claims, 5 Drawing Sheets

DEEP DRAW SUPERPLASTICALLY FORMED PART USING PRETHINNING

This is a continuation application based upon U.S. patent application Ser. No. 08/466,507, filed Jun. 6, 1995, which was a division of U.S. application Ser. No. 08/224,212 filed on Apr. 7, 1994, now U.S. Pat. No. 5,823,032.

This invention relates to superplastic forming of materials, and more particularly to a method for controlling the thickness of the material in the formed part at the particular locations of interest on the part.

BACKGROUND OF THE INVENTION

Superplastic forming of aluminum, titanium and other metal parts is widely practiced especially in the aerospace industry. The process includes placing a sheet of metal having superplastic characteristics between a die lid and a die base, heating the die and the captured sheet of metal to a temperature at which the metal exhibits superplastic characteristics, applying force to the die lid to hold it closed on the die base against the gas pressure which will be applied against the metal inside the die, and applying the gas pressure to cause the metal to stretch into the die cavity in the base and conform to the surface of the die cavity which is the shape of the final part. After forming, the die lid is removed and a part is cooled and removed from the die base cavity.

A long term problem in the use of the superplastic forming process which has received many attempts over the years at a solution is the excessive thinning of the part in certain areas such as the lower inside corners of concaved parts. Excessive thinning of the part in localized areas such as this can make the part unacceptable and require expensive solutions such as making the part in two pieces and welding the pieces together, or making the part with material that is thicker than necessary just to attain the required thickness at the corners or other areas that experience excessive thinning.

One known technique for minimizing thickness when forming superplastic material onto a convex die is to first expand the metal blank into a cavity in the lid to preform the blank so that when the pressure is reversed, the blank is formed downwardly over the convex mold in the die base. This technique improves the thickness uniformity but does not solve the problem of localized thinning in corners of deep concave dies or thinning around tall thin convex forms. Other processes are available which require multiple processing of the blank which increases the handling cost and can result in undesirable metallurgical characteristics because of the multiple heating cycles. Thus, the art has long sought a process by which the thickness of the part in particular areas of concern can be tailored to provide either uniform thickness throughout the entire part, even in areas where uniform thickness has not been possible in the past, or localized area of thickness on parts which needs strengthening in particular areas of the part.

SUMMARY OF THE INVENTION

This invention provides a process for tailoring the thickness of a superplastically formed part to provide uniform thickness throughout the part, even in inner corners of deep concaved parts in a single cycle in a die. The invention also preferably provides a method of prethinning superplastic metal blank in a die during the same cycle the part in the die is to be formed, to eliminate undesirable variations in thickness different locations on the part. A superplastic forming die has localized recess in the die lid into which localized areas of the metal blank can be formed to prethin the blank to tailor the thickness of the formed part in areas of particular interest for uniformity or for increased thickness at areas where increased strength is desired.

These and other features of the invention are attained in a strain equalization technique which superplastically preforms the metal diaphragm in an otherwise low strain zone to maximize final part thickness in an otherwise high strain zone. The preforming alters the diaphragm at the outset of the final form operation such that prethinned materials is deposited on the die surface, permitting unthinned diaphragm material to advance further into the deeper pockets of the contoured die than it could have otherwise done. Greater diaphragm thickness at this intermediate stage of forming results in a thicker part at the completion of forming in these deeper pockets. The process can also be employed to produce prethinned areas that will allow unthinned diaphragm material to be delivered to localized locations on the die cavity surface that need to be stronger and thicker to resist greater stress anticipated in those localized areas.

DESCRIPTION OF THE DRAWINGS

The invention and its many attendant objects and advantages will become more clear when reading the following description of the preferred embodiment in conjunction with the following drawings, wherein.

DESCRIPTION THE PREFERRED EMBODIMENTS

Figure 1:
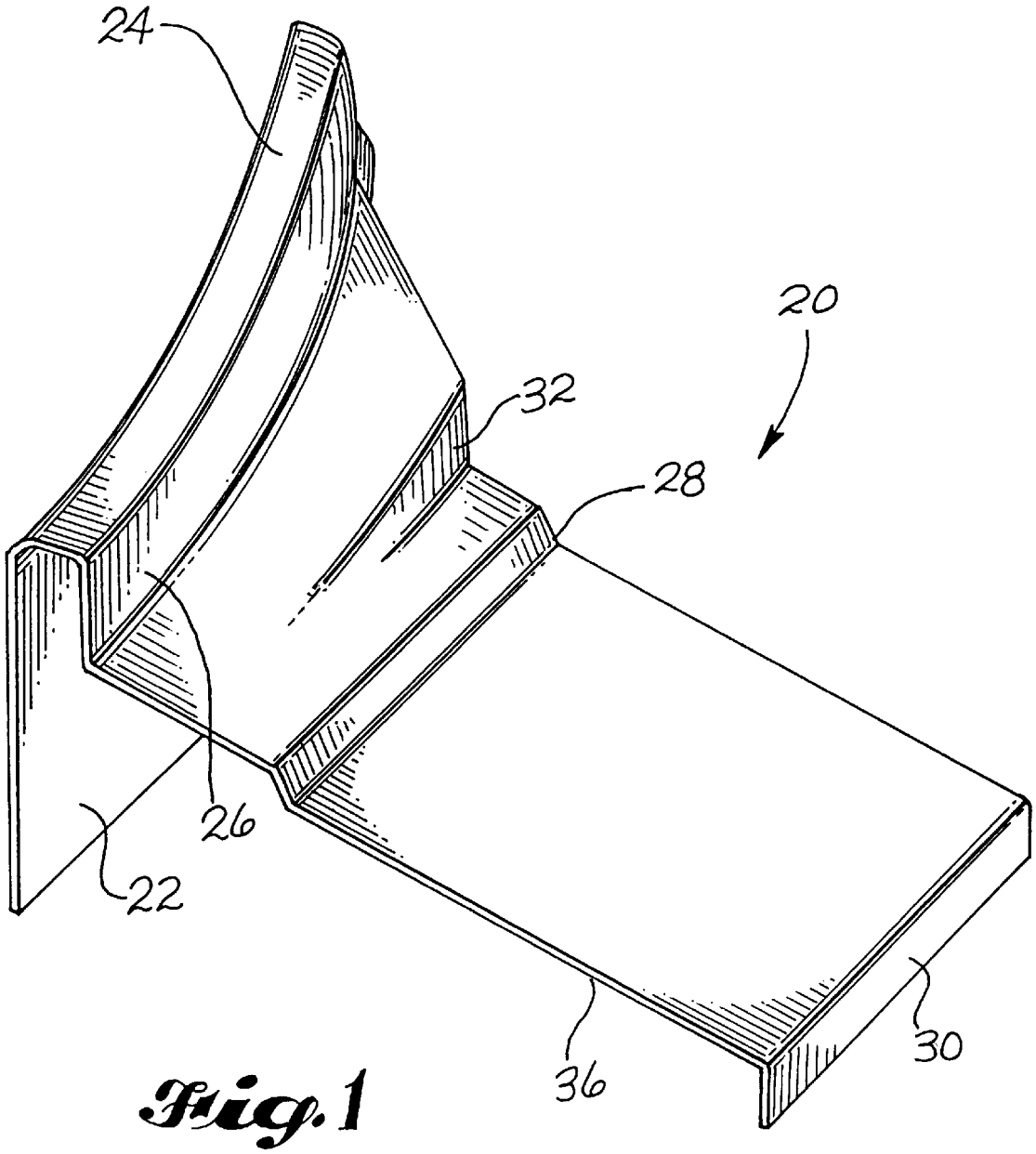
FIG. 1 is a perspective view of a part formed according to this invention.
Figure 2:
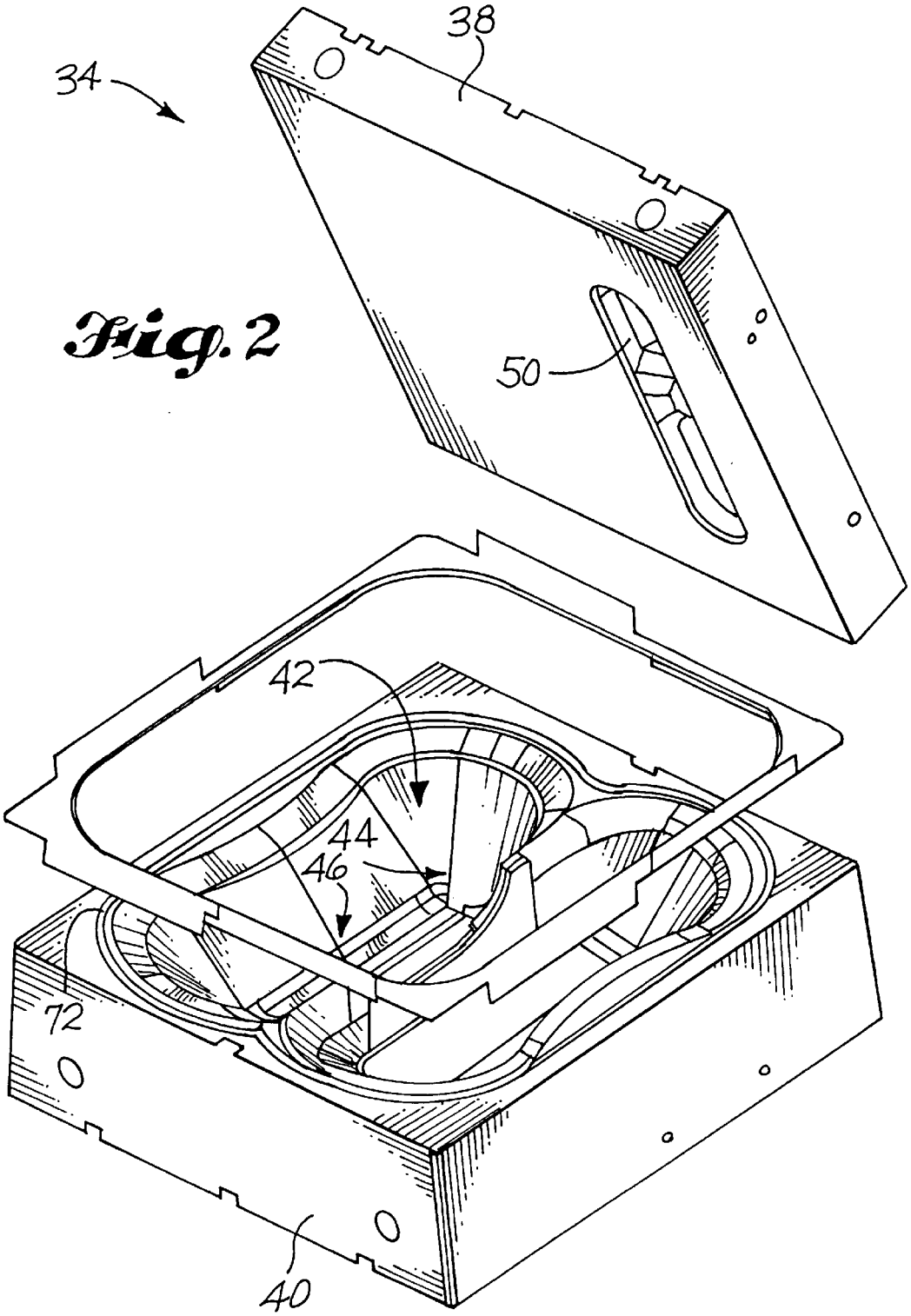
FIG. 2 is a superplastic forming die for making the part illustrated in FIG. 1.

Referring now to the drawings, wherein like reference characters designate identical or corresponding parts, in more particularly to FIG. 1 thereof, a part 20 is shown having a curved vertical end wall 22, a crest 24, a curved substantially vertical step 26, two straight steps 28 and 30 and a step 32 which extends partially across the width of the part. The part 20 is formed in a die 34 shown in FIG. 2. The die 34 is actually designed to make two parts simultaneously which are then cut apart on a center parting line 36 and trimmed to make the final part. The die 34 includes a die lid 38 and a die base 40. The die base 40 has a cavity 42 having a topography shaped like the part 20 on one side 44 of the cavity 42, and the other side 46 of the cavity 42 is shaped like the other part (not shown).

A recess 50 is provided in the lid 38 for preforming a blank 52 of superplastic material such as titanium in the die 34. The recess 50, also shown in figure three, is vented through a vent hole 54 into a gas channel 56 by which the die lid 38 can be connected to a gas pressure control system 58 such as the one shown in U.S. Pat. No. 5,419,170 entitled "Gas Control for Superplastic Forming", which is incorporated by reference. This gas control system enables the blank 52 to be preformed into the recess 50 and then formed into the cavity 42.

The cavity 42 in the die base 40 includes a mold form having a topography like the cross-sectional shape of the part 20. The mold form 60 includes a vertical face 62 and other steps and geometrical shapes corresponding to the shape of the part 20. Two vents 64 and 66 communicate with a gas channel 68 by which the cavity 42 can be connected to the same gas management system 58 through gas lines 69.

In operation, the blank 52 is inserted into the die 34 between the lid 38 and the die base 40. The die lid is closed over the top of the die base 40 and pressure is exerted by a press as indicated by force arrows 70. The force is concentrated on a seal bead 72 around the periphery of the cavity 42 to provide a continuous seal region between the die lid 34 and the die base 40 to ensure that forming gas when delivered to the die cavity 42 does not escape from the die 34.

Heat is applied to the die 34, usually by preheating the die in a separate oven and also by applying heat through the platens of the press. The heat in the die 34 heats the blank 52 to its superplastic temperature, that is the temperature that the material can be formed superplastically by gas pressure acting against one or the other surfaces of the blank 52. When the blank 52 reaches superplastic temperature, gas pressure is delivered from the gas management system 58 through the line 69 and gas channel 60 through the vents, 64 and 66 to pressurize the cavity 42. Simultaneously the gas management system 58 vents the recess 50 through the vent 54 and the gas channel 56 and through the gas line 59 to allow the blank 52 to be formed superplastically by the gas pressure in the cavity 42 up into the recess 50. The recess 50 is circular in cross-section at its base transitioning to an entry radii of about 0.75" or greater to prevent localized thinning of the blank 52 as it preforms into the recess 50. The depth of the recess 50 is slightly smaller than the width of the recess just inside of the entry radii. These proportions insure that the blank 52 will be prethinned to the amount required for the application while leaving an opening that is unimpeded when the blank preformed section is reversed into the cavity 42 as a bulge 74. These proportions provide a sufficiently increased surface area of the recess of 50 over the surface area of the opening of the recess 50 to achieve sufficient prethinning of the blank 52.

After the blank 52 has been preformed into the recess 50 the gas pressure in the die is reversed to vent the cavity 42 and to deliver forming gas under pressure to the gas line 59, gas channel 56 and the vent 54. This reversed gas pressure causes the prethinned portion of the blank 52 to extend downward into the die cavity as a prethinned bulge 74. The prethinned bulge 74 continues to translate into the cavity 42 until it contacts the sloping surface 76 in the cavity 42. It is problematical whether the superplastic material will stick to the die when it contacts the die surface or will slide across the die, but in this die geometry, I believe that the prethinned bulge 74 slides downward along the sloping surface 76 under the influence of gas pressure above the blank 52 and straightens the curved portion 78 of the blank 52 above the prethinned bulge 74 and to the right in FIGS. 3 and 4.

Simultaneously with the sliding of the preformed bulge 74 down the surface 76, the unthinned portion of the blank 52 will be pushed downward into the die cavity about its contact point with crest of the mold form 60 until it reaches a position corresponding about to line 80. At this position, the prethinned portion of the blank 52 has been laid flat against the surface of the die cavity 42 and has delivered the unthinned portion 81 of the blank 52 to the position indicated by line 80. The unthinned portion 81 is now superplastically formed against the bottom of the cavity 42 and against the vertical face 62 of the mold form 60.

Figure 4:
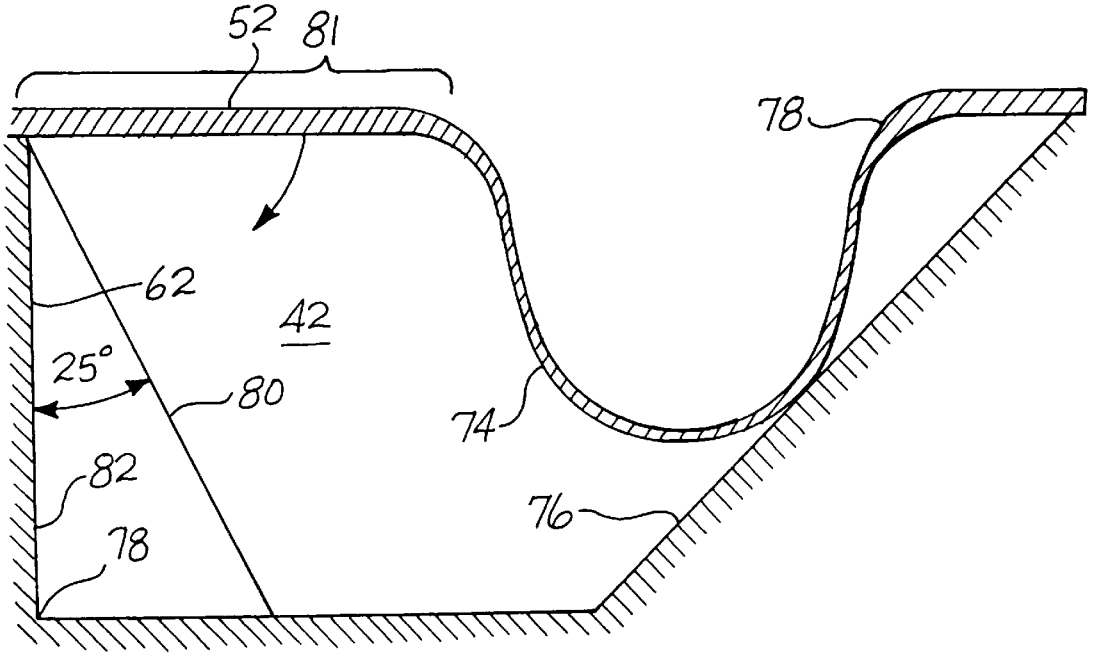
FIG. 4 is an enlarged view of a portion of the die base shown in FIG. 3 and the blank at the moment it touches the die cavity surface.

Because of the prethinning of the bulge 74, the surface area of the prethinned portion of the blank 52 is substantially increased which enables the blank to be formed into the die cavity by the forming gas pressure before any substantial thinning of the unthinned portion 81 of the blank begins. The path length of the prethinned portion of the blank shown in FIG. 4 is preferably about 65–95% of the path length of the corresponding portion of the part, thereby enabling the unthinned portion 81 to be delivered to the position 80 in relatively thick condition so that it does not become excessively thinned in the small amount of forming it must undergo during forming against the small section of cavity bottom to the left of the line 80 and the vertical face of the mold form.

Figure 6:
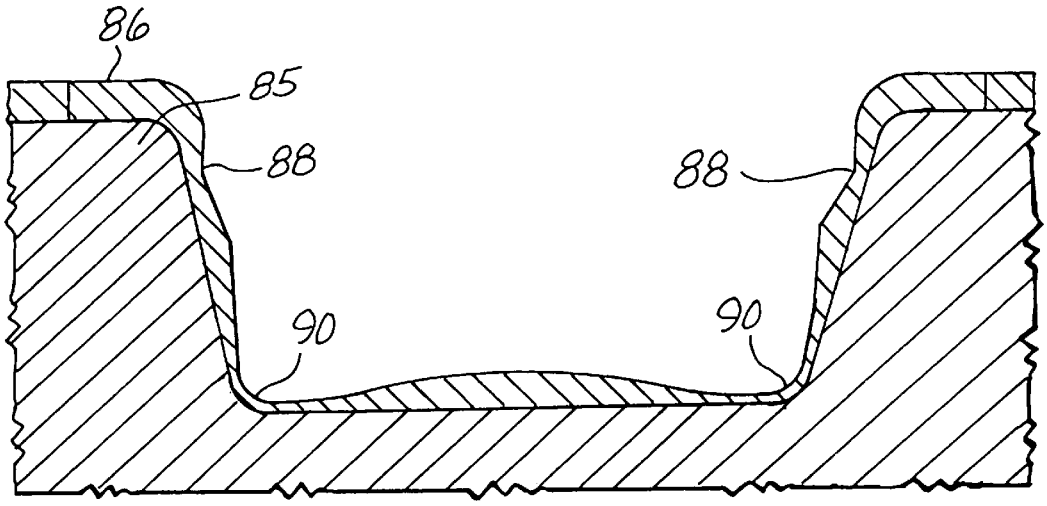
FIG. 6 is a cross-sectional elevation of a prior art superplastic forming die base illustrating an exaggerated pattern of thinning which parts of this general configuration often experience.

The bulge 74 is positioned outside of the boundries of the part 20, and the mold form 60 is a convex shape. A second embodiment, illustrated in FIG. 5, positions the prethinned blank material within the boundaries of the part and the mold form is concave. This embodiment, illustrated as a generic baking dish shape, has deep, steep sidewalls and a flat bottom. The part thickness distribution often encountered in superplastic forming parts of this nature, as illustrated in exaggerated form for clarity of illustration in FIG. 6, is an excessively thick flange 86, substantially the original thickness of the blank 84, occasional thinning below the shoulders 85 just below where the flange 86 transitions into the sidewall, and often excessive thinning of the bottom inside corners 90. I believe that the excessive thinning in the corners 90 is a consequence of the blank 84 sticking to the center of the floor 94 of the die cavity 92, after which it no longer contributes to the thinning of the blank. Thus, all the thinning that results from the forming of the blank into the lower inside corners of the die cavity must be contributed by the relatively small amount of blank material between the shoulder region and the center region of the die cavity floor 94. Since this portion of the blank material had already experienced some thinning during the forming into the die cavity, the additional thinning during final forming into the corners greatly increases the thinning in this last-to-form region and often produces the thinnest areas on the part.

Figure 3:
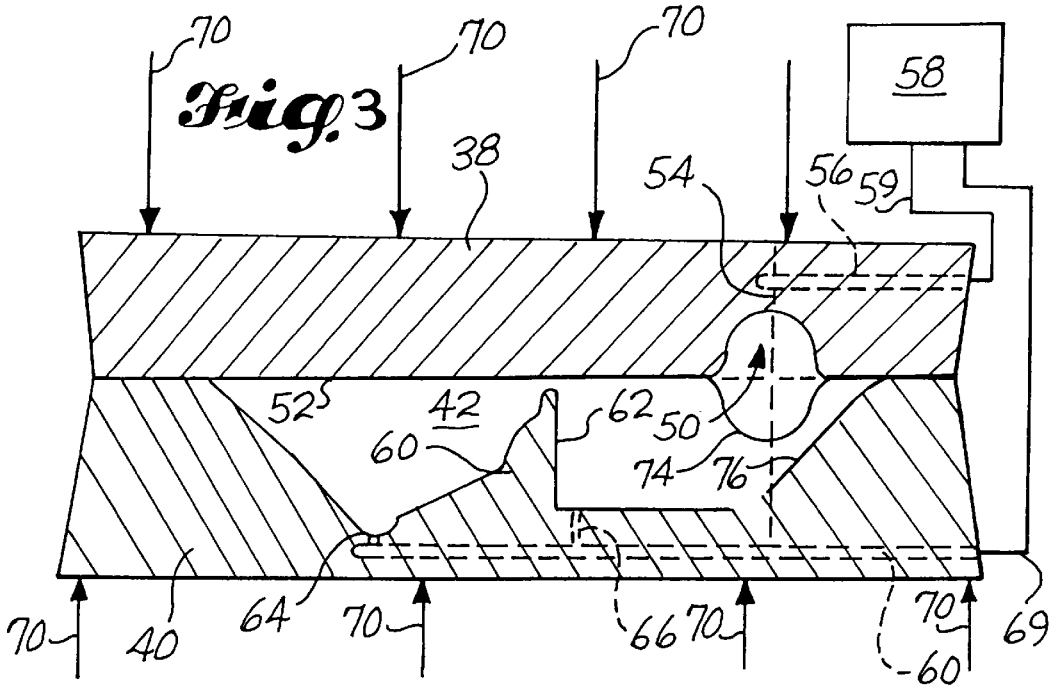
FIG. 3 is a cross-sectional elevation of the die shown in FIG. 2 showing the die closed on a superplastic material blank.
Figure 5:
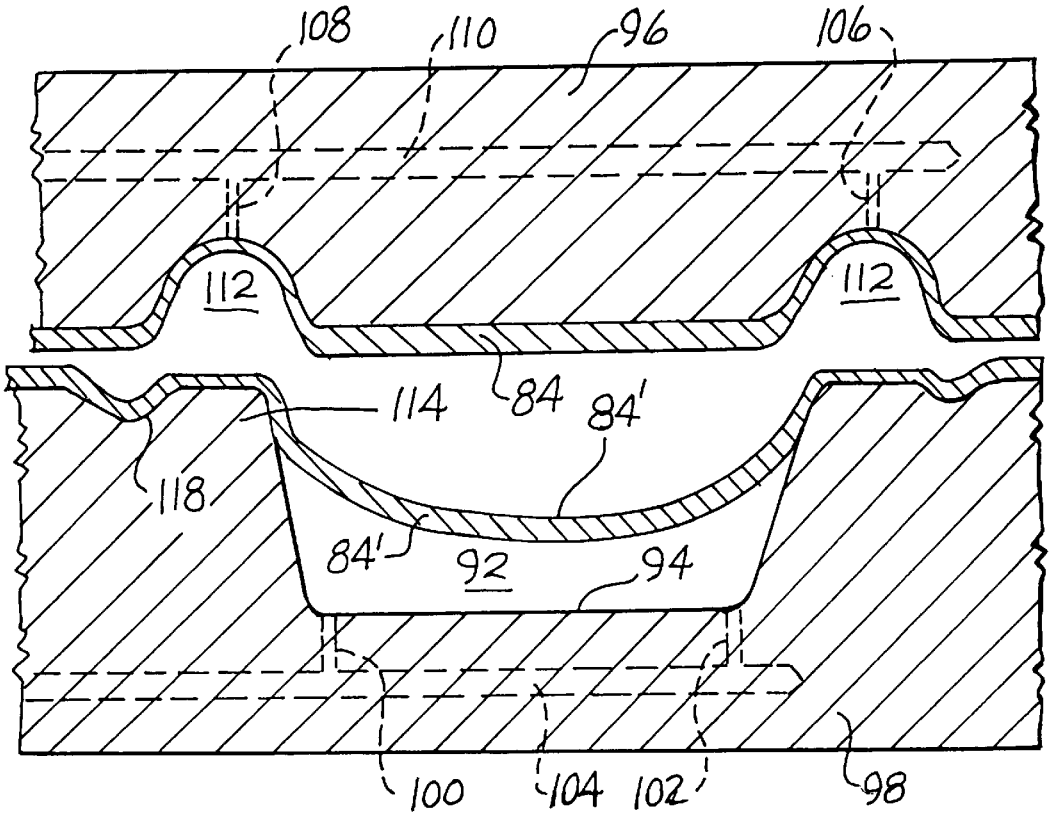
FIG. 5 is a cross-sectional elevation of a superplastic forming die made in accordance with this invention, showing a blank of superplastic material in two successive positions during forming.

To counteract this effect, the die shown in FIG. 5 has a die lid 96 having an annular peripheral recess 112 positioned in the region over the shoulder 114 of the die base cavity. The proportions of the recess are such that the surface area of the recess is about 1.5–3.5 times greater than the surface area of the opening of the recess in the plane of the underside of the die lid 96, which produces significant prethinning of the blank 84 without impeding the reversal of the prethinned bulge of the blank, as described below. A pair of vents 106 and 108 is provided in the deepest part of the recess and connect with a gas channel 110. Likewise, a pair of vents 100 and 102 are provided in the bottom inside corners of the die base cavity 92 and connect with a gas channel 104. The gas channels 104 and 110 connect to gas lines (not shown) for connection to a gas management system 58 in the same manner as illustrated in FIG. 3.

In operation, the blank 84 is inserted into a heated die between the die lid 96 and the die base 98 and pressure is applied to hold the die lid against the die base with the blank 84 clamped around the peripheral edges of the die. The heated die is then purged of air, and when the temperature of the blank reaches the superplastic forming temperature of the blank material, gas pressure is introduced into the cavity 92 through the gas channel from the gas management system 58. The blank is locally preformed into the recess 112 and the pressure is then reversed by the gas management system 58 to vent the cavity 92 and pressurize the area under the die lid 96 through the gas channel 110. The forming gas pressure acts against the prethinned annular bulge in the recess 112 and reverses the bulge downwardly into the cavity, to drape over the shoulders 114 of the die cavity 92 as illustrated in the successively formed view of the blank at 84'. At this point, the central portion of the blank 84' has not experienced any substantial thinning and remains approximately the same thickness as the original blank. Superplastic forming of the blank 84' now begins at the position of the blank 84' shown in FIG. 5, but there is now more material to form since the material that would otherwise have been wasted in the thick flange 86 is now available for forming in the central portion of the blank 84.

When the blank has formed down into the cavity far enough to contact the floor 94, it will stick to the floor 94 where it makes contact, and that portion of the blank will no longer be available to contribute to the overall thinning of the blank 84'. However, the central portion of the blank 84' is largely unthinned at this point because the preformed peripheral bulge now draped over the shoulders 114 of the cavity 92 have positioned the blank 84' well into the cavity, so relatively little forming was necessary before the center of the blank 84' contacted the die cavity floor 94. As a consequence, there is sufficient blank material available to contribute to the final forming into the inside corners of the cavity 94 without causing excessive thinning.

Figure 8:
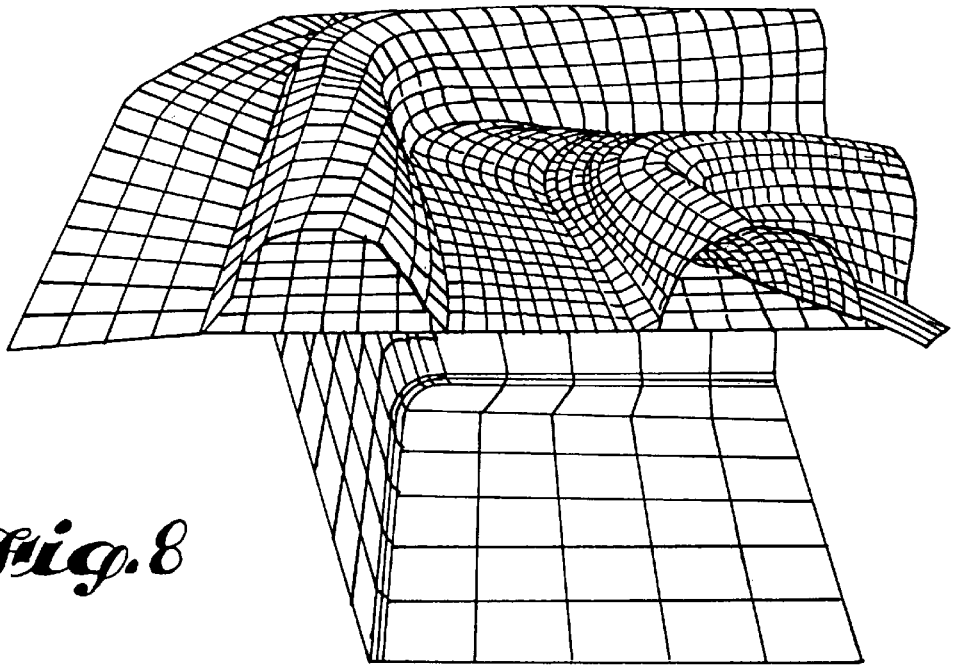
FIG. 8 is a wire frame perspective view snowing the superplastic material blank that was preformed into the lid of the die shown in FIG. 7 and is beginning to be formed down into the cavity in the die base of FIG. 7.
Figure 7:
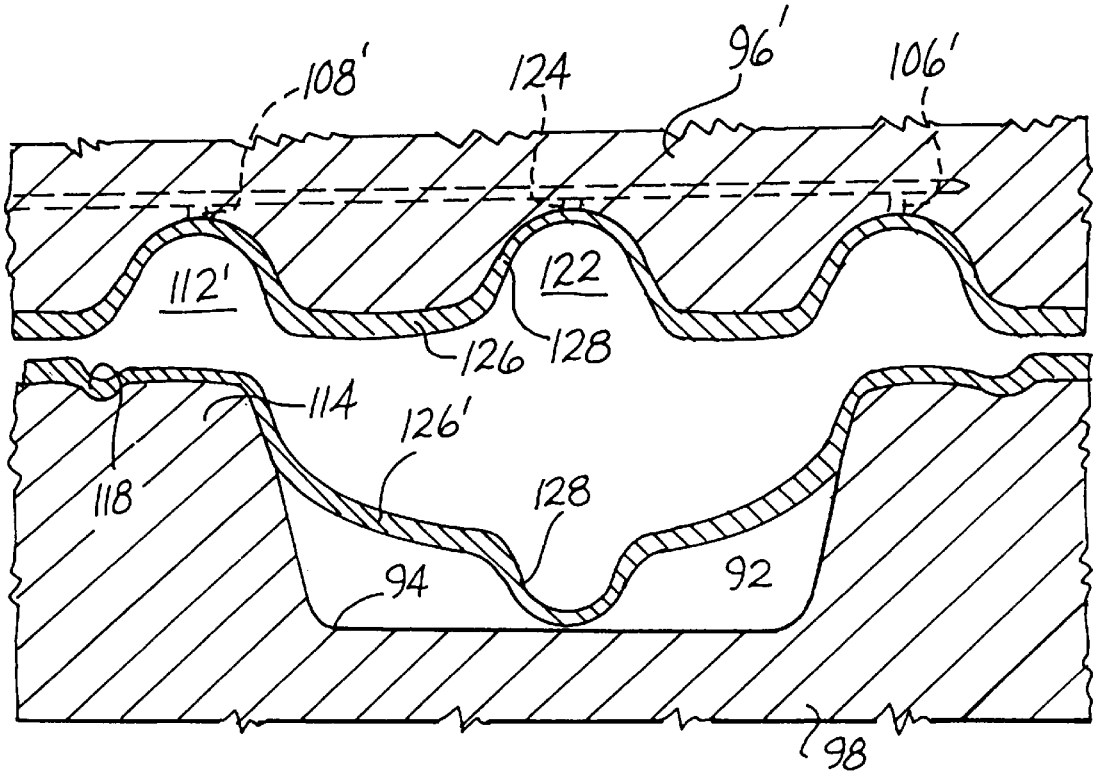
FIG. 7 is a cross-sectional elevation of a superplastic forming die in accordance with a refinement of the invention illustrated in FIG. 5.

Turning now to FIGS. 7 and 8, a refinement of the invention is shown having the same die base 98 as the embodiment of FIG. 5, including the same cavity and the same wrinkle control groove 118. It also has the same vents and gas channel for connection to the same gas management system 58, although these gas control features are omitted from FIG. 7 for clarity of illustration. The lid 96' is also identical, with the same annular recess 112' as in the lid 96 and the same gas control features as in the lid 96, except that the lid 96' has a central recess 122 and a vent 124 connection from the deepest part of the recess 122 to the gas channel 96'.

In operation, a blank 126 is preformed into the central recess 122 at the same time it is preformed into the peripheral annular recess 112' to produce a prethinned central bulge 128. After preforming into the lid 96', the gas pressure from the gas management control system is reversed to vent the cavity 92 and pressurize the area under the lid. The gas pressure reverses the central bulge 128 as illustrated in an initial stage in FIG. 8 and illustrated fully reversed in the successive position of the blank 126' shown in FIG. 7. In the position of the blank shown at 126', the prefornmed, prethinned annular bulge in the recess 112' has been reversed and is now draped over the shoulders 114 of the cavity 92. The center bulge 128 is fully reversed and is in contact with the floor 94 of the die cavity 92. The portion of the blank 126' between the center bulge 128 and the annular bulge draped over the shoulders 114 is substantially unthinned at this point. Consequently, the material of the blank has been distributed in such a way as to provide a relatively thick band of material for the final forming into the inside corners of the die cavity 92. In this way, the inside corners can be made as thick or even thicker if desired than the other portions of the part.

The invention can be applied selectively to provide tailored thickness on a superplastically formed part to achieve uniform thickness, which is the usual requirement, or to provide regions of greater thickness at areas of a part that might be expected to experience stress concentrations. The die for each part will need to be individually designed to achieve the desired distribution of thickness. In general, the localized prethinning recesses in the lid of the die will be positioned such the the prethinned material delivers portions of the blank substantially unthinned to the areas of the mold surface in the die base where the desired thickness is to be located.

Obviously, numerous modifications and variation of the described preferred embodiments will occur to those skilled in the art in light of this disclosure. Accordingly, it is expressly to be understood that these variations and modifications, and the equivalents thereof, may be practiced while remaining within the spirit and scope of the invention as defined in the following claims, wherein I claim:

1. A superplastically formed part made from a blank having a substantially uniform, original thickness, the part comprising:

a prethinned portion of the part formed from the blank and having substantially uniform thickness about 25–66% of the original thickness of the blank, the prethinned portion being formed by superplastically creating a bulge in the blank using fluid pressure against the blank in a die to form the blank in a first direction before reversing the pressure to superplastically form the blank opposite the first direction into a forming die; and a deep draw corner and an adjacent wall in the superplastically formed part defined by features in the forming die, the corner and wall having substantially uniform thickness, the wall being substantially uniformly thick where conventional superplastic forming would produce a wall having a significant taper in its thickness because of premature contact between the blank and the die;

the forming die having a cavity containing a profile having male die features, including the corner and wall, corresponding to the finished part, wherein the prethinned portion is in a trim margin of the part surrounding the corner and wall.

2. The part of claim 1 wherein the wall is steeply sloped and extends from the corner to a peak, the thickness of the peak, corner, and wall being substantially the same and substantially uniform.

3. A part formed by superplastically deforming a substantially uniformly thick blank of superplastic sheet material with gas pressure in a two step expansion of the sheet, the part being made by the process comprising the steps of:

(a) prethinning a bulge into the blank by superplastically expanding a portion of the blank into a bulge recess in one die of a complementary, matching die set holding the blank, the expansion forming a prethinned blank that has a thinned bulge and a surrounding unthinned portion of the blank;

(b) superplastically forming the prethinned blank into a forming die cavity of the other die in the die set, the cavity having an overall concave configuration with at least one male topographic feature protruding in at least one portion of the cavity within the overall concave configuration, the male topographic feature defining the shape of the formed part, wherein the bulge contacts a die wall along the concave portion of the die cavity first while the unthinned portion of the blank contacts the male topographic feature, the male feature defining in the part a steeply sloped wall of substantially uniform thickness;

(c) removing the formed blank from the cavity; and (d) trimming the bulge from the formed blank to complete the part.

4. The part of claim 3 wherein the blank is aluminum or titanium.

5. The part of claim 4 wherein the bulge recess has an opening and has a surface area of about 1.5–3.5 times greater than the area of the opening of the recess.

* * * * *